United States Patent [19]

Nishi

[11] 4,308,735

[45] Jan. 5, 1982

[54] AUTOMATIC PRESSURE CONTROL APPARATUS FOR COUNTERBALANCER

[75] Inventor: Ikuo Nishi, Komatsu, Japan

[73] Assignee: Kabushiki Kaisha Komatsu Seisakusho, Tokyo, Japan

[21] Appl. No.: 126,963

[22] Filed: Mar. 3, 1980

[30] Foreign Application Priority Data

Mar. 1, 1979 [JP] Japan ..... 54-22558

[51] Int. Cl.[3] ..... B21J 9/20

[52] U.S. Cl. ..... 72/21; 72/20; 72/453.18; 100/259

[58] Field of Search ..... 72/19, 20, 445, 453.18, 72/465, 21; 100/48, 259; 267/119

[56] References Cited

U.S. PATENT DOCUMENTS 3,825,811 7/1974 Smith et al. ..... 72/20

4,011,809 3/1977 Waller et al. ..... 100/259

*Primary Examiner*—Lowell A. Larson

*Attorney, Agent, or Firm*—Armstrong, Nikaido, Marmelstein & Kubovcik

[57] ABSTRACT

An automatic pressure control apparatus for a counterbalancer of a press having a movable portion including a crank, a connecting rod, a slide and an upper die detachably mounted on the slide, the apparatus comprising a cylinder mounted on a frame of the press, a piston rod of the cylinder being connected to the slide, a tank for pressurized fluid connected to a source of pressurized fluid and a rod-side chamber of the cylinder, a pressurized fluid supply and ventilation control unit disposed between the source of the pressurized fluid and the tank, the unit having a pilot operated main regulator valve for regulating the pressurized fluid flowing therethrough, a plurality of pilot regulator valves connected with the main regulator valve for controlling the same, a detector for detecting the amount of displacement of a reference point given on the movable portion of the press in a preselected posture thereof in response to the interchange of the upper dies with varying weights, and a solenoid valve for selectively operating the pilot regulator valve in response to a detected signal detected by the detector.

3 Claims, 2 Drawing Figures

AUTOMATIC PRESSURE CONTROL APPARATUS FOR COUNTERBALANCER

BACKGROUND OF THE INVENTION

This invention relates to an automatic pressure control apparatus for a counterbalancer fitted to a press.

A conventional press is provided with a counterbalancer for supporting the weight of slides, cranks, connecting rods, punches or upper dies so as to enable smooth upward and downward movements of the slides. Regarding the counterbalancer, it is necessary to vary its supporting force depending on the weight of the upper die to be fitted to the slide. For this reason, there have heretofore been suggested various kinds of automatic control apparatus for counterbalancers wherein the weight to be supported by the counterbalancer can be automatically adjusted depending on the weight of the upper die. One of such embodiments is disclosed in the Japanese Utility Model Publication No. 21813/1978. According to the invention of this Utility Model, the arrangement is made such that, each time when the weight of the upper die to be fitted to the slide varies, a stop valve located between an air reservoir and a pressure supply source is shut off and, at the same time, a manually operable stop valve is opened so as to lower the pressure within the air reservoir communicating with a balance cylinder to the level of the balancing pressure which is obtainable when the upper slide is not fitted to the slide thereby adjusting the height of the slide, and thereafter the stop valve on the side of the pressure supply source is opened, and simultaneously the manually operable stop valve on the pressure release side is shut off, and subsequently, a reducing valve is manually adjusted while observing the pressure inside the air reservoir by means of its pressure gauge so that the pressure in the pressure chamber of the balance cylinder can be set at a value necessary for suspending the upper die.

However, the apparatus described in the aforementioned Utility Model Publication is disadvantageous in that the manual adjustments of the balance pressure require troublesome operations and tend to cause adjustment errors.

SUMMARY OF THE INVENTION

It is therefore an object of the present invention to provide a pressure control apparatus for a counterbalancer of a press wherein the pressure within the counterbalancer can be automatically changed in response to the interchange of upper dies with varying weights.

Another object of the present invention is to provide an automatic pressure control apparatus for a counterbalancer of a press which can effectively prevent misadjustments of the counterbalancer.

In accordance with an aspect of the present invention, there is provided an automatic pressure control apparatus for a counterbalancer of a press having a movable portion including a crank for translating rotary motion into linear motion, a connecting rod connected to the crank, a slide connected to the connecting rod, and an upper die detachably mounted on the slide; the automatic pressure control apparatus comprising cylinder means mounted on a frame of said press machine, said cylinder means having a piston with a piston rod slidably mounted therein, and a rod-side chamber defined therein, said piston rod being connected to said slide; a pressurized fluid source; tank means for containing pressurized fluid connected at one end thereof with said pressurized fluid source, the other end thereof being connected to the rod-side chamber of said cylinder means; pressurized fluid supply and ventilation control means disposed between said pressurized fluid source and said tank means for controlling the supply and ventilation of the pressurized fluid into and from the rod-side chamber of said cylinder means, said pressurized fluid supply and ventilation control means having pilot operated main regulator valve means for regulating the pressurized fluid flowing therethrough; a plurality of pilot regulator valve means connected with said main regulator valve means for controlling the same; detector means for detecting the amount of displacement of a reference point given on the movable portion of the press machine in a preselected posture of the press in response to the interchange of the upper dies with varying weights; and means for selectively operating said pilot regulator valve means in response to a detected signal detected by said detector means whereby the fluid pressure in the rod-side chamber of said cylinder means can be automatically controlled in response to the amount of displacement of the reference point.

The above and other objects, features and advantages of the present invention will be readily apparent from the following description taken in conjunction with the accompanying drawings.

DETAILED DESCRIPTION OF THE INVENTION

Figure 1:
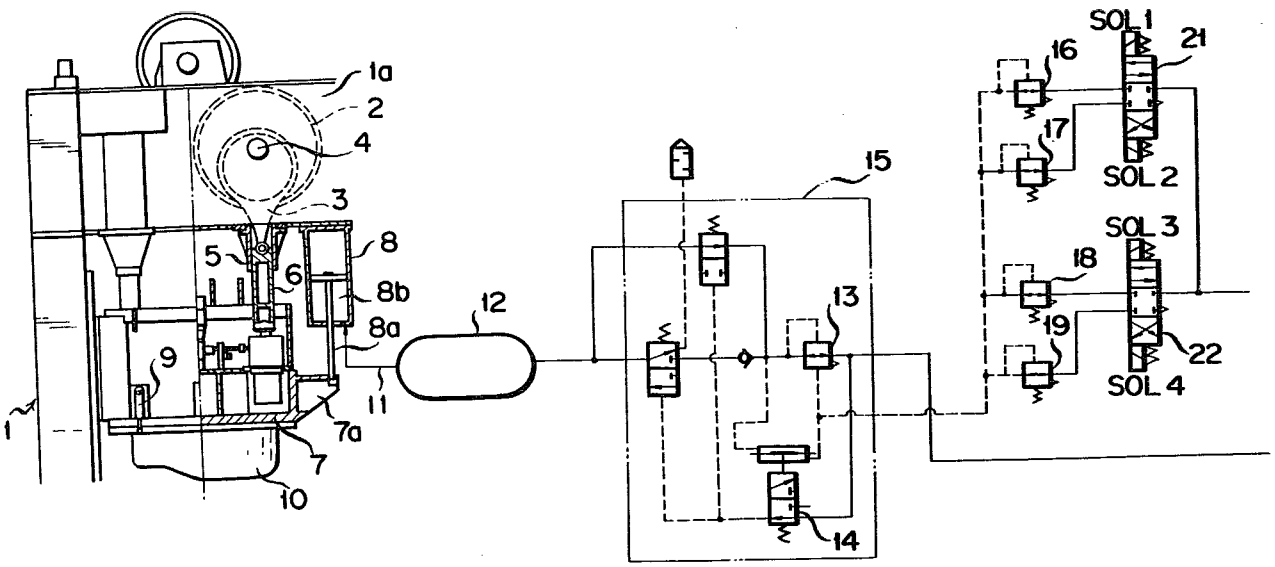
FIG. 1 is an overall constructional view of a counterbalancer of a press with the press being shown in front elevation partly in cross-section.

The present invention will now be described below by way of example only with reference to the accompanying drawings. In FIG. 1, reference numeral 1 denotes a press machine. Accommodated in a crown 1*a* of the press machine is a crank 3 adapted to be driven or rotated through a main gear 2 by a prime mover not shown. Reference numeral 4 denotes a crankshaft. The lower end of the crank 3 is pivotally connected to the upper end of a connecting rod 6, the upward and downward movements of which is guided by a guide bush 5. The lower end of the connecting rod 6 is connected to a slide 7 which is carried so as to move up and down freely underneath the crown 1*a*. Secured to the side of the slide 7 is or are a single or a plurality of balance cylinders 8 fixedly secured to the lower face of the crown 1*a*. The leading end of a piston rod 8*a* projecting through the balance cylinder 8 is fixedly secured to a bracket 7*a* extending from the slide 7. The arrangement is made such that the weights of the crank 3, the connecting rod 6, the slide 7 and the upper die 10 which is detachably mounted through a die chamber 9 on the lower face of the slide 7 can be supported by the balance cylinders 8.

Whilst, a pressure chamber 8*b* on the rod side of the aforementioned balance cylinder 8 is connected through a conduit 11 to an air reservoir 12.

Compressed air set at a proper pressure is supplied from a pneumatic pressure supply source (not shown)

through a main air supply and ventilation unit 15 comprising a main regulator valve 13 and a diaphragm valve 14 into the air reservoir 12. The above-mentioned main regulator valve 13 of the main air supply and ventilation unit 15 is controlled by a pilot pressure supplied through a plurality of, for example, four sets of pilot regulator valves 16, 17, 18 and 19 so that the air in the air reservoir 12 can be set at a pressure suited to the weight of the upper die 10.

Stating in brief, the pilot regulator valve 16 is preset so as to balance under the condition the upper die 10 is not fitted to the slide 7, and the pilot regulator valve 19 is preset so as to balance when the upper die 10 of a maximum weight is fitted to the slide 7. The rest pilot regulator valves 17 and 18 are preset at a pressure equally dividing the difference in the pressures of the pilot regulator valves 16 and 19. A pneumatic pressure is supplied into the pilot regulator valves 16, 17, 18 and 19 through solenoid valves 21 and 22 which are controlled or changed over by a control means 20.

Figure 2:
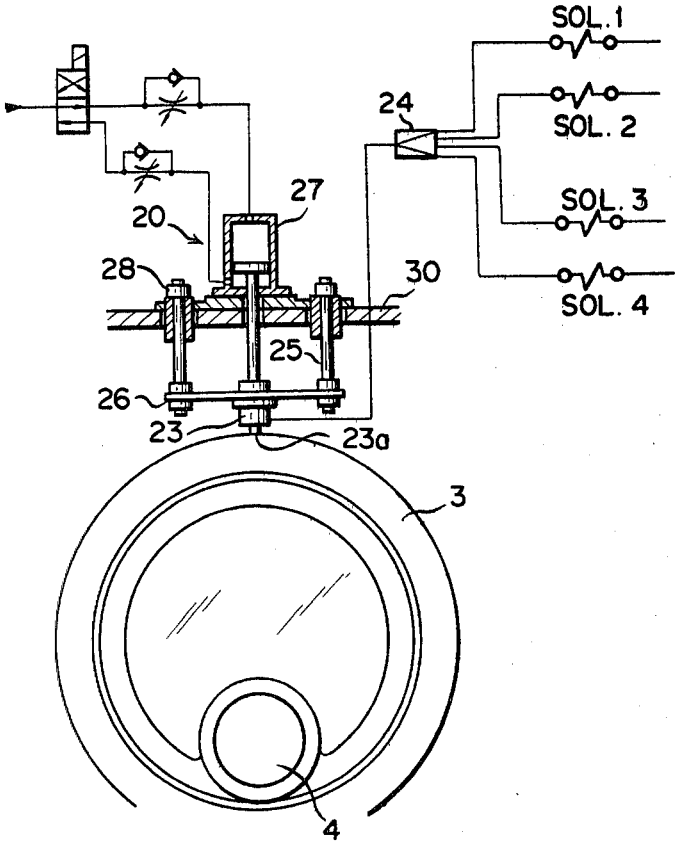
FIG. 2 is a schematic constructional view of detector means employed in the present invention.

The above-mentioned control means 20 is constructed as shown in FIG. 2. A detector 23 is provided above the crank 3 so as to contact with it at the top dead center of the slide 7. The detector 23 is, for example, a differential transformer which is adapted to generate different electric signals (or votages) depending on the vertical position of the crank 3 at the top dead center of the slide 7. The electric signal is amplified by an amplifier 24 and then sent to either of exciter coils $SOL_1$, $SOL_2$, $SOL_3$ and $SOL_4$ of the solenoid valves 21 and 22 depending on the voltage level. The detector 23 is fitted to the lower face of a mounting plate 26 and is guided by guide rods 25 attached to a frame 30 of the crown 1*a* so as to move up and down freely. The mounting plate 26 can be moved up and down by the action of a lift cylinder 27.

Thus, the slide 7 to which the upper die 10 is not fitted is lowered to its bottom dead center and the main regulator valve 13 is controlled by the pressure preset by the pilot regulator valve 16 so as to reduce the pressure within the air reservoir 12 to the balancing pressure which is obtained when the upper die 10 is not fitted thereby adjusting the height of the slide 7. In the next place, the upper die 10 of a spontaneous weight is attached to the slide 7, and the slide 7 is moved upward to its top dead center. The arrival of the slide 7 at the top dead center is checked by a top dead center checking means (not shown), and at the same time, the detector 23 is lowered by the lift cylinder 27 to its lower limit position which is restricted by stoppers 28 fitted to the upper ends of the guide rods 25 so that a detector member 23*a* of the detector 23 may abut against the crank 3. By such arrangement, different voltages can be induced within the detector 23 in response to the vertical position of the crank 3 which varies with the weight of the upper die 10 fitted to the slide 7. Depending on the magnitude or level of the detection signals, either one of the exciter coils $SOL_2$, $SOL_3$ and $SOL_4$ of the solenoid valves 21 and 22 is excited so that the main regulator valve 13 is controlled through either of the pilot regulator valves 17, 18 or 19 thereby ensuring that the air pressure within the air reservoir 12 is automatically adjusted to a balancing pressure suited to the weight of the upper die 10.

Further, though the adjustments of the balancing pressure are made stepwise, the adjustable range of pressure can be made more accurate by increasing the number of the pilot regulator valves 16, 17, 18 and 19 and that of the solenoid valves 21 and 22. Further, during the operation of the press, the detector 23 may, of course, be moved upwards by the lift cylinder 27 so as to avoid the contact of the detector with the crank 3. Moreover, in the aforementioned example of the present invention, the detector 23 is located above the crank 3 so as to detect the load imposed on the slide by the amount of lowering of the crank 3; however, the detector 23 may be mounted on any part which is suspended by the balance cylinder 8. Further, it is, of course, possible to adjust the pneumatic pressure by means of an automatic regulator valve provided with an electric motor adapted to be energized by electric signals detected by the detector 23 in place of the solenoid valves 21 and 22.

As described in detail hereinabove, according to the present invention, the air pressure within the pressure chamber of the balance cylinder can be automatically adjusted by merely fitting an upper die to the slide even when the weight of the upper die is unknown. Therefore, according to the present invention, as compared to the conventional manually adjusted apparatus, there is no need of effecting troublesome adjusting operations, and also there is no possibility of occurrence of adjustment errors.

While the invention has been described and shown with particular reference to the preferred embodiment, it will be apparent that variations might be possible that would fall within the scope of the present invention, which is not intended to be limited except as defined in the following claims.

What I claim is:

1. In a press machine having a movable portion including a crank for translating rotary motion into linear motion, a connecting rod connected to the crank, a slide connected to the connecting rod, and an upper die detachably mounted on the slide; an automatic pressure control apparatus for a counterbalancer, comprising: cylinder means mounted on a frame of said press machine, said cylinder means having a piston with a piston rod slidably mounted therein, and a rod-side chamber defined therein, said piston rod being connected to said slide; a pressurized fluid source; tank means for containing pressurized fluid connected at one end thereof with said pressurized fluid source, the other end thereof being connected to the rod-side chamber of said cylinder means; pressurized fluid supply and ventilation control means disposed between said pressurized fluid source and said tank means for controlling the supply and ventilation of the pressurized fluid into and from the rod-side chamber of said cylinder means, said pressurized fluid supply and ventilation control means having pilot operated main regulator valve means for regulating the pressurized fluid flowing therethrough; a plurality of pilot regulator valve means connected with said main regulator valve means for controlling the same; detector means movable into and out of physical contact with the movable portion of the press machine for directly measuring the amount of displacement of a reference point given on the movable portion of the press machine in a preselected posture of the press in response to the interchange of the upper dies with varying weights; and means for selectively operating said pilot regulator valve means in response to a detected signal detected by said detector means whereby the fluid pressure in the rod-side chamber of said cylinder means can be automatically controlled in response to the amount of displacement of the reference point.

2. An automatic pressure control apparatus for a counterbalancer as recited in claim 1 wherein said means for selectively operating said pilot regulator valve means is a solenoid valve and said detector means includes a differential transformer.

3. An automatic pressure control apparatus for a counterbalancer as recited in claim 1 or 2 wherein the reference point is the uppermost point of the crank when the crank is moved to its upper dead center and said detector means is mounted above the crank to detect the amount of displacement of the reference point.

* * * * *